United States Patent [19]

Masumoto et al.

[11] Patent Number: 4,655,857

[45] Date of Patent: Apr. 7, 1987

[54] NI-CR TYPE ALLOY MATERIAL

[75] Inventors: Tsuyoshi Masumoto, No. 8-22, Kamisugi 3-chome, Sendai-shi, Miyagi; Akihisa Inoue, Miyagi; Hiroyuki Tomioka, Kyoto, all of Japan

[73] Assignees: Tsuyoshi Masumoto; Unitika Ltd., both of Japan

[21] Appl. No.: 473,403

[22] Filed: Mar. 8, 1983

[30] Foreign Application Priority Data

Mar. 8, 1982 [JP] Japan ..... 57-36225

[51] Int. Cl.[4] ..... C22C 19/05

[52] U.S. Cl. ..... 148/423; 148/427; 148/428; 148/442

[58] Field of Search ..... 420/442, 441, 443, 445–454, 420/428, 582–588; 148/423, 427, 428, 442

[56] References Cited

U.S. PATENT DOCUMENTS 3,856,513 12/1974 Chen et al. ..... 420/441

*Primary Examiner*—R. Dean

*Attorney, Agent, or Firm*—Sughrue, Mion, Zinn, Macpeak, and Seas

[57] ABSTRACT

Ni-Cr type allow materials comprising 10 to 50 atom % of Cr, 5 to 25 atom % of Al and/or Si, and the balance to make up 100 atom % of substantially pure Ni, excelling in cold workability, and exhibiting high electric resistance.

These alloy materials possess very high electric resistance and small electrical resistance temperature coefficients over a wide temperature range from room temperature to elevated temperatures, and have excellent cold workability, mechanical properties, durability, ability to resist oxidation, corrosion, and fatigue as well as strain gauge sensitivity. The alloys are very useful as industrial materials of varying types including electrical resistors, precision resistors, and electrically heating wires used at elevated temperatures and bracing materials, reinforcing materials, and corrosionproofed materials used at elevated temperatures.

8 Claims, No Drawings

NI-CR TYPE ALLOY MATERIAL

FIELD OF THE INVENTION

This invention relates to Ni-Cr type alloy materials which have excellent cold workability and show low electrical resistance temperature coefficients over a wide temperature range from room temperature through elevated temperatures, as well as a high degree of electrical resistance.

BACKGROUND OF THE INVENTION

Ni-Cr type alloy materials have generally been widely used as heating elements at elevated temperatures and as electrical resistors at elevated temperatures. The reason for this favorable acceptance is that the Ni-Cr type alloy materials, as compared with the Fe-Cr-Al type alloy materials, for example, have advantages such as not being easily embrittled even after exposure to heat, exhibiting high strength and other mechanical properties at elevated temperatures, and having sufficient stability to withstand virtually all corrosive gases except sulfide gases. On the other hand, they have disadvantages such as lower degrees of electrical resistance, larger electrical resistance temperature coefficients at varying temperatures from room temperature through elevated temperatures, and slightly lower maximum working temperatures than the Fe-Cr-Al type alloys. Moreover, they do not fully satisfy other requirements such as having an ability to resist the action of acids.

Generally, it is possible to improve the ability of Ni-Cr type alloy materials to resist acid and enhance their electrical resistance up to the level of 115 $\mu\Omega$-cm by fixing their Cr contents in the range of 40 to 45 atom%. However, this increase in the Cr contents results in degradation of workability of alloy materials. Normally, therefore, Ni-Cr type alloy materials having Cr contents controlled to the neighborhood of 20 atom% for the purpose of ensuring ample cold-moldability are used. Efforts to improve the aforementioned disadvantages by the incorporation of Al and Si have been separately continued. Since it has been ascertained that their incorporation heavily impairs workability even to the extent of rendering cold working or coiling impracticable the incorporation of Al and Si is now limited to 3 atom% at most.

SUMMARY OF THE INVENTION

An object of the present invention is to provide Ni-Cr type alloy materials which have excellent cold workability and show low electrical resistance temperature coefficients over a wide temperature range from room temperature through elevated temperatures, as well as a high degree of electrical resistance.

The present inventors have found that the above object is attained by preparing a Ni-Cr type alloy of a specific composition and solidifying the alloy still in a molten state by quenching.

This invention is directed to Ni-Cr type alloy materials comprising 10 to 50 atom% Cr, 5 to 25 atom% of Al and/or Si, and the balance to make up 100 atom% of substantially pure Ni. The alloy has excellent cold workability and exhibits a high degree of electrical resistance. The invention is also directed to Ni-Cr type alloy materials comprising (a) 10 to 50 atom% of Cr, (b) 5 to 25 atom% of Al and/or Si, (c) 0.1 to 40 atom% of at least one element selected from the group consisting of Fe, Co, Nb, Ta, V, Mo, Mn, Cu, Ge, Ga, Ti, Zr, Hf, Ca, Ce, Y, and Th (providing that the content of Fe is 0.1 to 40 atom%, that of each of Co, Nb, Ta, V, Mo, Mn, Cu, Ge, and Ga 0.1 to 3.0 atom%, and/or that of each of Ti, Zr, Hf, Ca, Ce, Y, and Th 0.1 to 1.0 atom%, and (d) the balance to make up 100 atom% of substantially pure Ni. This alloy also has excellent cold workability and exhibits a high degree of electrical resistance.

The alloy materials of the present invention are solid solutions of 10 to 50 atom% of Cr and 5 to 25 atom% of Al and/or Si in substantially pure Ni. These alloy materials exhibit much higher values of electrical resistance, lower electrical resistance temperature coefficients over a wide temperature range from room temperature through elevated temperatures, better mechanical properties, ability to resist oxidation, corrosion and fatigue longer service life, and higher degrees of strain gauge sensitivity than conventional Ni-Cr type alloy materials. Therefore, alloys of this invention are highly useful as industrial materials of varying types including electrical resistors, precision resistors, and electrical heating wires at elevated temperatures and bracing materials, reinforcing materials, and corrosion resistant materials which must be used at elevated temperatures.

DETAILED DESCRIPTION OF THE INVENTION

The alloy materials contemplated by this invention contain 10 to 50 atom% of Cr and 5 to 25 atom% of Al and/or Si. The Cr content is preferably in the range of 15 to 45 atom% and more preferably in the range of 30 to 37 atom%. The Al and/or Si content preferably falls in the range of 7 to 20 atom% and more preferably in the range of 7 to 15 atom%.

If the Cr content is less than 10 atom% and/or the Al and/or Si content is less than 5 atom%, the produced alloy materials will not have improved electrical resistance, electrical resistance temperature coefficient, oxidationproofness, mechanical properties, corrosionproofness, and fatigue resistance. If the Cr content exceeds 50 atom% and/or the Al and/or Si content exceeds 25 atom%, the alloy materials obtained by quenching suffer from precipitation of such compounds as $Ni_3Si$, $Ni_3Al$, NiAl, and $Ni_3Cr_2Si_1$. Therefore, the alloys become brittle and deficient in workability, and do not have practical utility. Particularly when the Cr content is in the neighborhood of 40 atom%, the alloy materials exhibit the maximum electric resistance. This electrical resistance tends to fall gradually as the Cr content increases beyond this level.

The alloy materials of the present invention have further improved workability, electrical resistance, tensile strength at rupture and other mechanical properties, and longer service life. These properties made be improved by incorporating therein 0.1 to 40 atom% of at least one element selected from the group consisting of Fe, Co, Nb, Ta, V, Mo, Mn, Cu, Ge, Ga, Ti, Zr, Hf, Ca, Ce, Y, and Th (providing that the content of Fe is 0.1 to 40 atom%, that of each of Co, Nb, Ta, V, Mo, Mn, Cu, Ge, and Ga 0.1 to 3.0 atom%, and/or that of each of Ti, Zr, Hf, Ca, Ce, Y, and Th 0.1 to 1.0 atom%. Particularly the Fe content in the range of 10 to 40 atom% proves desirable because the presence of this Fe enhances workability and, at the same time, lowers cost without appreciably degrading heat resistance and gas resistance. The elements such as Co, Nb, Ta, V, Mo, Mn, Cu, Ge, Ga, Ti, Zr, and Hf are effective in improving heat resistance, thermal expansion coefficient, electrical resistance, tensile strength at rupture and other mechanical properties. The elements such as Ca, Ce, Y, and Th are effective in lengthening service life. However, when these elements are incorporated in amounts exceeding the upper limits mentioned above, the alloy materials suffer from loss of cold workability, becoming brittle, and no longer suit practical utility.

In the aforementioned alloy compositions of the present invention, when the Cr content is limited to the range of 15 to 35 atom% and the Al and/or Si content to the range of 7 to 20 atom%, produced alloy materials enjoy lowered thermal electromotive force relative to copper and increased strain gauge ratio (strain gauge sensitivity) and, accordingly, prove to be highly desirable materials for strain gauges.

Any of the alloy systems of this invention mentioned above tolerates presence of such impurities as B, P, C, S, Sn, In, As, and Sb in amounts normally found in most industrial materials of ordinary run. The presence of these impurities in such insignificant amounts does not impair the objects of this invention.

Manufacture of an alloy material of this invention is accomplished by preparing the component elements in amounts making up a selected percentage composition, melting the component elements by heating either in natural atmosphere or under a vacuum, and quenching the resultant molten solid solution. Although various other methods are available for this quenching, the liquid quenching methods represented by the one-roll method and the two-roll method and the spinning-in-rotary liquid method prove to be particularly effective. Alloys in the shape of plates can be manufactured by the piston-anvil method, the splat quenching method, etc. The aforementioned liquid quenching methods (one-roll method, two-roll method, and spinning-in-rotary liquid method) have quenching speeds about $10^{4°}$ to $10^{5°}$ C./sec. and the piston-anvil method and the splat quenching method have quenching speeds of about $10^{5°}$ to $10^{6°}$ C./sec. By adoption of one of these quenching methods, therefore, the molten solid solution can be efficiently quenched.

The spinning-in-rotary liquid method, as disclosed in Japanese Patent Application (OPI) No. 64948/80 (The term "OPI" as used herein refers to a "published unexamined Japanese patent application".) is an operation which comprises placing water in a rotary drum, allowing the water to form a film of water on the inner wall of the rotary drum by virtue of the centrifugal force, spouting the molten alloy through a spinning nozzle into the film of water, and producing a thin alloy wire having a circular cross section. To produce this thin alloy wire in a uniform size without breakage, the peripheral speed of the rotary drum is preferably equal to or greater than the speed of the flow of molten alloy spouted out of the spinning nozzle. It is particularly desirable for the peripheral speed of the rotary drum to be 5 to 30% higher than the speed of the flow of molten alloy spouted out of the spinning nozzle. The angle to be formed between the flow of molten alloy spouted out of the spinning nozzle and the film of water formed on the inner wall of the rotary drum is desired to be at least 20°, preferably 40° to 90°.

Since the alloy material of the present invention contains a large amount of Si and/or Al, when the molten alloy is spouted into the aforementioned coolant in rotary motion to be quenched and solidified, there can be obtained a continuous thin alloy wire which enjoys a uniform circular cross section and suffers very little from uneven diameter distribution. Moreover, since the incorporation of Si and/or Al in the Ni-Cr alloy serves to enhance various properties as described above and, at the same time, impart substantial ability to form a thin alloy wire in a liquid coolant (the nature of the molten alloy, on being quenched and solidified in the liquid coolant, to form a uniform thin alloy wire having a circular cross section and suffering very little from uneven diameter distribution), it proves highly desirable for the purpose of obtaining a uniform thin alloy wire having a circular cross section.

The alloy material of the present invention can be subjected to cold working continuously. In order to improve dimensional accuracy and mechanical properties, the alloy material may be rolled into sheets or drawn into wires. When necessary, it may be subjected to thermal treatments such as annealing. The high speed and simple procedure of the liquid quenching method contribute to lowering the production cost and the energy requirement in the manufacture of the material contemplated by the present invention.

The use of such a liquid quenching method makes it possible to manufacture an alloy material formed of supersaturated solid solution having a widely variable percentage composition including 10 to 50 atom% of Cr and 5 to 25 atom% of Al and/or Si, combining relatively high tensile strength at rupture with high tenacity, and possessing a face-centered cubic structure. The alloy material thus manufactured possesses higher electric resistance than conventional Ni-Cr alloy materials. When the alloy is used as an electrical resistor, it can be expected to exhibit more desirable results with respect to thermal resistance, as well as resistances to oxidation, corrosion and fatigue, durability and strain gauge sensitivity. For example, the material obtained by quenching a molten alloy consisting of 55 atom% of Ni, 35 atom% of Cr, and 10 atom% of Si by the one-roll method exhibits a high electrical resistance of 150 $\mu\Omega$-cm. Moreover, this alloy material has high tenacity, abounds in ductility, shows a high rupture strength of about 65 kg/mm$^2$, and permits cold rolling. When the Cr and Si contents are further increased, however, the electric resistance and the ductility tend to be gradually impaired, although the strength at rupture is improved. This trend is also found in the Ni-Cr-Al type alloy materials. An alloy composition of 70 atom% of Ni, 20 atom% of Cr, and 10 atom% of Al exhibits the maximum electric resistance of 145 $\mu\Omega$-cm. When the Cr and Al contents are further increased, the electric resistance and the ductility tend to fall gradually, although the rupture strength is increased.

The alloy materials described above are substantially better than conventional Ni-Cr type alloy materials in terms of cold workability, electric properties and mechanical properties, as well as their abilities to resist corrosion, oxidation, and fatigue, and to provide a longer service life. Accordingly, alloys of the invention are highly useful as industrial materials of varying types including electrical resistors, precision resistors, and electrically heating wires at elevated temperatures and bracing materials, reinforcing materials, and corrosion resistant materials used at elevated temperatures.

The present invention will now be described more specifically below with reference to working examples. However, the invention is not limited to these examples.

EXAMPLES 1 TO 8 AND COMPARATIVE EXAMPLES 1 TO 4

A Ni-Cr-Si alloy of a varying percentage composition indicated in Table 1 was melted in an atmosphere of argon. Under an argon gas pressure of 1.0 kg/cm$^2$, the resultant molten alloy was spewed through a spinning nozzle made of ruby and having an orifice diameter of 0.5 mmϕ onto the surface of a steel roll having a diameter of 20 cm and rotating at 2500 r.p.m. to produce a continuous ribbon 50 μm in thickness and 3 mm in width. The ribbon was tested by the four-terminal method for electrical resistance (electrical specific resistance in μΩ-cm), for electrical resistance temperature coefficient in a temperature range of from room temperature through 800° C., by the Instron type tensile tester for strength at rupture (in kg/mm$^2$), for elongation at rupture (in %), and for 180° intimate-contact bending property.

The results are collectively shown in Table 1.

TABLE 1

| Run No. | Example No. | Alloy Composition (atom %) | Electrical Specific Resistance (μΩ-cm) | Electrical Resistance Temperature Coefficient ($10^{-5}$ $K^{-1}$) | Strength at Rupture (kg/mm$^2$) | Elongation at Rupture (%) | 180° Intimate-Contact Bending Property |
|---|---|---|---|---|---|---|---|
| 1 | Comparative Example 1 | $Ni_{78}Cr_{20}Si_2$ | 95 | 26 | 30 | 25 | Good |
| 2 | Example 1 | $Ni_{75}Cr_{20}Si_5$ | 105 | 11 | 36 | 20 | Good |
| 3 | Example 2 | $Ni_{70}Cr_{20}Si_{10}$ | 110 | 12 | 49 | 15 | Good |
| 4 | Example 3 | $Ni_{65}Cr_{20}Si_{15}$ | 120 | 0 | 55 | 12 | Good |
| 5 | Example 4 | $Ni_{60}Cr_{20}Si_{20}$ | 125 | 4 | 60 | 8 | Good |
| 6 | Comparative Example 2 | $Ni_{52}Cr_{20}Si_{28}$ | — | — | — | — | Not Good |
| 7 | Comparative Example 3 | $Ni_{82}Cr_8Si_{10}$ | 90 | 17 | 35 | 25 | Good |
| 8 | Example 5 | $Ni_{75}Cr_{15}Si_{10}$ | 105 | 13 | 40 | 20 | Good |
| 9 | Example 6 | $Ni_{65}Cr_{25}Si_{10}$ | 130 | 7 | 55 | 15 | Good |
| 10 | Example 7 | $Ni_{55}Cr_{35}Si_{10}$ | 150 | 5 | 65 | 9 | Good |
| 11 | Example 8 | $Ni_{45}Cr_{45}Si_{10}$ | 135 | 4 | 80 | 5 | Good |
| 12 | Comparative Example 4 | $Ni_{35}Cr_{55}Si_{10}$ | — | — | — | — | Not Good |

Note:
"Good" means that the rupture or breakage does not occur when subjected to the test for 180° C. intimate-contact bending property and the complete intimately contact bending property can be obtained.
"Not Good" means that the rupture or breakage occur in the 180° C. intimate-contact bending property test, and the sample embrittled.

It is noted from Table 1 that Run Nos. 2 to 5 and Nos. 8 to 11 produced alloy materials conforming to the requirements of the present invention. Because they had high Cr and Si contents, they exhibited improved degrees of strength at rupture (tensile strength at rupture), higher degrees of electrical specific resistance, and smaller electrical resistance temperature coefficients. The alloy materials of Run Nos. 1 and 7 contained Si and Cr both in insufficient amounts and, therefore, exhibited low degrees of electrical resistance and strength at rupture and large electrical resistance temperature coefficients. They were not improved. The alloy materials of Run No. 6 and No. 12 contained Si and Cr both in excessive amounts and, therefore, did not allow further solid solution of Si and Cr in Ni. The ribbon alloys obtained from these alloy materials were too brittle to withstand the procedures in volved in the test for electrical properties and mechanical properties.

The ribbon alloys obtained in Run Nos. 2 to 5 and Nos. 8 to 11 could be rolled to a thickness of 10 μm without undergoing intermediate annealing. Particularly, the ribbon alloy of Run No. 10 exhibited an improved strength at rupture of 130 kg/mm$^2$ after rolling. This sample was subjected to five cycles of heat treatment each consisting of heating from room temperature to 950° C. and cooling from 950° C. back to room temperature and, at the end of the last cycle of heat treatment, tested for brittleness. It was confirmed that the heat treatment did not embrittle the sample at all but increased the electrical specific resistance to 160 μΩ-cm and lowered the electrical resistance temperature coefficient to $1\times10^{-5}K^{-1}$. Thus, the heat treatment brought about a notable improvement.

The strength at rupture and the elongation were both measured by an Instron type tensile tester under the conditions of 2 cm of test length and $4.17\times10^{-4}$/sec of strain speed.

EXAMPLES 9 TO 15 AND COMPARATIVE EXAMPLES 5 TO 8

A Ni-Cr-Al alloy of a varying percentage composition indicated in Table 2 was melted in an atmosphere of argon. Under an argon gas pressure of 4.0 kg/cm$^2$, the molten alloy was spewed through a spinning nozzle made of ruby and having an orifice diameter of 0.10 mmϕ into a rotating body of cooling water 2.5 cm in depth kept at 4° C. on the inside of a rotary drum having an inside diameter of 500 mmϕ and rotated at a speed of 400 r.p.m. to be quenched and solidified. Consequently, there was produced a continuous thin wire of a circular cross section having an average diameter of about 0.095 mmϕ.

In this case, the distance between the spinning nozzle and the surface of the rotating body of cooling water was kept at 1.5 mm and the angle formed between the flow of molten alloy spewed from the spinning nozzle and the surface of the rotating body of cooling water was kept at 65°.

The speed at which the molten alloy was spewed from the spinning nozzle was found to be about 500 to 610 m/minute. It was determined on the basis of the weight of the molten alloy which had been spewed out into the air and then collected to be weighted.

The thin wires obtained after quenching were severally tested for electrical specific resistance, electrical resistance temperature coefficient, strength at rupture, elongation at rupture, and 180° intimate-contact bending property. The results are collectively shown in Table 2.

It is noted from Table 2 that Run Nos. 14 to 17 and Nos. 20 to 22 produced alloy materials conforming to the requirements of the present invention. Because of their high Cr and Al contents, they exhibited high degrees of electrical specific resistance, low electrical resistance temperature coefficients, and high degrees of strength at rupture. The alloy materials of Run Nos. 13 and 19 contained Al and Cr both in insufficient amounts and, therefore, were inferior to the alloy materials of Run Nos. 14 to 17 and Nos. 20 to 22 in terms of electrical resistance and mechanical properties. The alloy materials of Run Nos. 18 and 23 contained Al and Cr both in excessive amounts. The thin wires obtained from these alloy materials were too brittle to produce test pieces capable of withstanding the procedures involves in the test for electrical resistance and mechanical properties.

TABLE 2

| Run No. | Example No. | Alloy Composition (atom %) | Electrical Specific Resistance ($\mu\Omega$-cm) | Electrical Resistance Temperature Coefficient ($10^{-5}$ $K^{-1}$) | Strength at Rupture (kg/mm$^2$) | Elongation at Rupture (%) | 180° Intimate-Contact Bending Property |
|---|---|---|---|---|---|---|---|
| 13 | Comparative Example 5 | $Ni_{78}Cr_{20}Al_2$ | 100 | 22 | 25 | 45 | Good |
| 14 | Example 9 | $Ni_{75}Cr_{20}Al_5$ | 118 | 12 | 31 | 42 | Good |
| 15 | Example 10 | $Ni_{70}Cr_{20}Al_{10}$ | 145 | 2 | 35 | 37 | Good |
| 16 | Example 11 | $Ni_{65}Cr_{20}Al_{15}$ | 135 | −1 | 40 | 32 | Good |
| 17 | Example 12 | $Ni_{60}Cr_{20}Al_{20}$ | 115 | 1 | 42 | 25 | Good |
| 18 | Comparative Example 6 | $Ni_{52}Cr_{20}Al_{28}$ | — | — | — | — | Not Good |
| 19 | Comparative Example 7 | $Ni_{82}Cr_8Al_{10}$ | 95 | 10 | 28 | 40 | Good |
| 20 | Example 13 | $Ni_{75}Cr_{15}Al_{10}$ | 130 | 3 | 33 | 38 | Good |
| 21 | Example 14 | $Ni_{60}Cr_{30}Al_{10}$ | 130 | 3 | 53 | 19 | Good |
| 22 | Example 15 | $Ni_{45}Cr_{45}Al_{10}$ | 115 | 2 | 60 | 10 | Good |
| 23 | Comparative Example 8 | $Ni_{35}Cr_{55}Al_{10}$ | — | — | — | — | Not Good |

Note:
"Good" means that the rupture or breakage does not occur when subjected to the test for 180° C. intimate-contact bending property and the complete intimately contact bending property can be obtained.
"Not Good" means that the rupture or breakage occur in the 180° C. intimate-contact bending property test, and the sample embrittled.

The thin wires from the alloy materials of Run Nos. 14 to 17 and Nos. 20 to 22 could be drawn with a diamond die to a diameter of 0.050 mm$\phi$ without undergoing any intermediate annealing. This drawing work could notably improve the strength at rupture (for example, the thin wire of Run No. 15, when cold drawn to 0.05 mm$\phi$ in diameter, exhibited an improved degree of strength at rupture of 115 kg/mm$^2$) without adversely affecting the electrical resistance temperature coefficient.

EXAMPLES 16 TO 22 AND COMPARATIVE EXAMPLES 9 TO 15

For the purpose of evaluating the effect of the incorporation of such additive elements (M) as Nb, Ta, V, Mo, Mn, Ti, and Zr upon the $Ni_{55}$-X.$Cr_{35}Si_{10}M_x$ alloy, a sample ribbon (50 $\mu$m in thickness and 3 mm in width) of a varying percentage composition indicated in Table 3 was prepared by using the same apparatus as in Example 1 and following the procedure of Example 1. It was then tested for electrical resistance, strength at rupture, elongation at rupture, and 180° intimate-contact bending property.

The results are collectively shown in Table 3.

TABLE 3

| Run No. | Example No. | Alloy Composition (atom %) | Electrical Specific Resistance ($\mu\Omega$-cm) | Strength at Rupture (kg/mm$^2$) | Elongation at Rupture (%) | 180° Intimate-Contact Bending Property |
|---|---|---|---|---|---|---|
| 24 | Example 16 | $Ni_{53}Cr_{35}Si_{10}Nb_2$ | 160 | 85 | 5 | Good |
| 25 | Comparative Example 9 | $Ni_{51.5}Cr_{35}Si_{10}Nb_{3.5}$ | — | — | — | Not Good |
| 26 | Example 17 | $Ni_{53}Cr_{35}Si_{10}Ta_2$ | 160 | 83 | 6 | Good |
| 27 | Comparative Example 10 | $Ni_{51.5}Cr_{35}Si_{10}Ta_{3.5}$ | — | — | — | Not Good |
| 28 | Example 18 | $Ni_{53}Cr_{35}Si_{10}V_2$ | 155 | 80 | 4 | Good |
| 29 | Comparative Example 11 | $Ni_{51.5}Cr_{35}Si_{10}V_{3.5}$ | — | — | — | Not Good |
| 30 | Example 19 | $Ni_{53}Cr_{35}Si_{10}Mo_2$ | 155 | 80 | 4 | Good |
| 31 | Comparative Example 12 | $Ni_{51.5}Cr_{53}Si_{10}Mo_{3.5}$ | — | — | — | Not Good |
| 32 | Example 20 | $Ni_{53}Cr_{35}Si_{10}Mn_2$ | 160 | 75 | 4 | Good |
| 33 | Comparative Example 13 | $Ni_{51.5}Cr_{35}Si_{10}Mn_{3.5}$ | — | — | — | Not Good |
| 34 | Example 21 | $Ni_{54.5}Cr_{35}Si_{10}Ti_{0.5}$ | 155 | 75 | 3 | Good |
| 35 | Comparative Example 14 | $Ni_{53.5}Cr_{35}Si_{10}Ti_{1.5}$ | — | — | — | Not Good |
| 36 | Example 22 | $Ni_{54.5}Cr_{35}Si_{10}Zr_{0.5}$ | 155 | 70 | 3 | Good |
| 37 | Comparative | $Ni_{53.5}Cr_{35}Si_{10}Zr_{1.5}$ | — | — | — | Not Good |

TABLE 3-continued

| Run No. | Example No. | Alloy Composition (atom %) | Electrical Specific Resistance (μΩ-cm) | Strength at Rupture (kg/mm²) | Elongation at Rupture (%) | 180° Intimate-Contact Bending Property |
|---|---|---|---|---|---|---|
| | Example 15 | | | | | |

Note:
"Good" means that the rupture or breakage does not occur when subjected to the test for 180° C. intimate-contact bending property and the complete intimately contact bending property can be obtained.
"Not Good" means that the rupture or breakage occur in the 180° C. intimate-contact bending property test, and the sample embrittled.

From Table 3, it is noted that Run Nos. 24, 26, 28, 30, 32, 34, adn 36 produced alloy materials conforming to the requirements of the present invention, respectively incorporating therein Nb, Ta, V, Mo, and Mn each in a proportion of 2 atom%, and Ti and Zr each in a proportion of 0.5 atom%. They enjoyed additions of 5 to 10 μΩ-cm to electrical specific resistance and additions of 5 to 20 kg/mm² to strength at rupture and invariably showed tenacity enough to permit 180° intimate-contact bending property.

The alloy materials of Run Nos. 25, 27, 29, 31, 33, 35, and 37 incorporated the additive elements in excessive amounts. The quenched ribbons obtained from these alloy materials were too brittle to afford test pieces capable of withstanding the procedures involved in the test for electrical resistance and mechanical properties.

EXAMPLE 23

An alloy composed of 35 atom% of Ni, 30 atom% of Fe, 20 atom% of Cr, 10 atom% of Si and 5 atom% of Al was melted in an atmosphere of argon. under an argon gas pressure of 4.5 kg/cm², the molten alloy was spewed out through a spinning nozzle made of ruby and having an orifice diameter of 0.15 mmϕ into a rotating body of aqueous sodium chloride solutions 3.0 cm in depth kept at −15° C. inside a rotary drum having an inside diameter of 650 mmϕ and rotating at a speed of 350 r.p.m. Consequently, there was obtained a highly uniform continuous thin wire of a circular cross section having an average diameter of 0.135 mmϕ and suffering very little from uneven diameter distribution.

In this case, the distance between the spinning nozzle and the surface of the rotating body of the aqueous solution was kept at 1.0 mm and the angle of contact formed between the flow of molten alloy spewed out of the spinning nozzle and the surface of the rotating body of the liquid coolant was kept at 80°.

The speed at which the molten alloy was spewed from the spinning nozzle was 640 m/min.

The thin wire possesses an electrical specific resistance of 155 μΩ-cm and a rupture strength of 55 kg/mm². It was highly tenacious and could be cold drawn easily to a diameter of 0.05 mmϕ by use of a diamond die. The drawing work improved the rupture strength to 120 kg/mm².

EXAMPLE 24

An alloy composed of 65 atom% of Ni, 20 atom% of Cr, 5 atom% of Si, and 10 atom% of Al was melted and spewed under an argon gas pressure of 1.0 kg/cm² through a spinning nozzle made of ruby and having an orifice diameter of 0.3 mmϕ onto the surface of a steel roll having a diameter of 20 cm and rotated at a speed of 5,000 r.p.m. Consequently, there was obtained a ribbon 8 μm in thickness and 2 mm in width. The ribbon sample was tested by the four-terminal method with an Instron type tensile tester for change in electric specific resistance at temperature from room temperature to 800° C. under application of stress to evaluate various physical properties and determine whether the ribbon was useful as a material for a strain gauge sensor. Consequently, the electrical specific resistance was 170 μΩ-cm, the electrical resistance temperature coefficient was $1\times10^{-5}K^{-1}$, the tensile strength was 38 kg/mm², the thermal electromotive force relative to copper was $0.5\times10^{-6}$ V/K, and the gauge ratio was about 6.0. These values warrant high usefulness of the ribbon as a material for a strain gauge.

While the invention has been described in detail and with reference to specific embodiments thereof, it will be apparent to one skilled in the art that various changes and modifications can be made therein without departing from the spirit and scope thereof.

What is claimed is:

1. A Ni-Cr type alloy material which has an excellent cold workability and shows a low electrical resistance temperature coefficient over a wide temperature range from room temperature through elevated temperatures and a high degree of electrical resistance, consisting essentially of:

Cr in an amount of 10 to 50 atom%;

at least one element selected from the group consisting of Al and Si in an amount of from 5 to 25 atom%; and substantially pure Ni in an amount within the range of 25 to 85 atom%, said Ni-Cr type alloy material being formed of a supersaturated solid solution possessing a face-centered cubic structure.

2. A Ni-Cr type alloy material which has an excellent cold workability and shows a low electrical resistance temperature coefficient over a wide temperature range from room temperature through elevated temperatures and a high degree of electrical resistance, consisting essentially of:

Cr in a amount of 10 to 50 atom%;

at least one element selected from the group consisting of Al and Si in an amount of from 5 to 25 atom%;

0.1 to 40 atom% of at least one element selected from the group consisting of Fe, Co, Nb, Ta, V, Mo, Mn, Cu, Ge, Ga, Ti, Zr, Hf, Ca, Ce, Y, and Th wherein the amount of Fe is 0.1 to 40 atom%, the amount of each of Co, Nb, Ta, V, Mo, Mn, Cu, Ge and Ga is 0.1 to 3.0 atom%, and/or the amount of each of Ti, Zr, Hf, Ca, Ce, Y, and Th is 0.1 to 1.0 atom%; and substantially pure Ni making up the balance of the alloy, said Ni-Cr type alloy material being formed of a supersaturated solid solution possessing a face-centered cubic structure.

3. An alloy as claimed in claim 1, wherein the Cr is present in an amount within the range of 15 to 45 atom%.

4. An alloy as claimed in claim 3, wherein Cr is present in an amount of 30 to 37 atom%.

5. An alloy as claimed in claim 1, wherein the element selected from the group consisting of Al and Si is present in an amount within the range of 7 to 20 atom%.

6. An alloy as claimed in claim 5, wherein the element selected from the group consisting of Al and Si is present in an amount of 7 to 15 atom%.

7. An alloy as claimed in claim 2, wherein Cr is present in an amount within the range of 15 to 45 atom%.

8. An alloy as claimed in claim 2, wherein the elements selected from the group consisting of Al and Si is present in an amount within the range of 7 to 20 atom%.

* * * * *